US011555666B1

(12) United States Patent
Moy

(10) Patent No.: US 11,555,666 B1
(45) Date of Patent: Jan. 17, 2023

(54) CLAY PIGEON SHOOTING SYSTEM AND METHOD OF USING THE SAME

(71) Applicant: Gerard E. Moy, Red Oak, TX (US)

(72) Inventor: Gerard E. Moy, Red Oak, TX (US)

( * ) Notice: Subject to any disclaimer, the term of this patent is extended or adjusted under 35 U.S.C. 154(b) by 407 days.

(21) Appl. No.: 16/357,924

(22) Filed: Mar. 19, 2019

(51) Int. Cl.
*F41C 23/08* (2006.01)

(52) U.S. Cl.
CPC ..... *F41C 23/08* (2013.01)

(58) Field of Classification Search
CPC ..... F41C 23/08
See application file for complete search history.

(56) References Cited

U.S. PATENT DOCUMENTS 412,479 A * 10/1889 Davis ..... A63B 60/08 264/271.1
544,269 A * 8/1895 Winters ..... F41C 23/08 42/74
1,538,990 A * 5/1925 Hawkins ..... F41C 23/08 42/74
1,805,273 A * 5/1931 Ammann ..... F41C 23/08 42/74
2,205,769 A * 6/1940 Sweetland ..... A63B 60/12 81/492
2,344,752 A * 3/1944 Utz ..... F41C 23/08 42/74
3,491,473 A * 1/1970 Eastin ..... F41C 23/06 42/74
3,696,544 A * 10/1972 Webb ..... F41C 23/08 42/74
4,316,342 A * 2/1982 Griggs ..... F41C 23/06 42/74
4,385,024 A * 5/1983 Tansill ..... A43B 7/28 264/223
4,504,604 A * 3/1985 Pilkington ..... C08L 65/00 42/74
4,599,920 A * 7/1986 Schmid ..... B25G 1/102 16/11
4,683,671 A * 8/1987 Farrar ..... F41C 23/08 42/74
4,934,024 A * 6/1990 Sexton, I ..... A63B 60/12 16/421
4,956,932 A * 9/1990 Cupp ..... F41C 23/08 42/74
4,998,367 A * 3/1991 Leibowitz ..... F41C 23/06 42/71.02
5,155,878 A * 10/1992 Dellis ..... B62K 21/26 16/421
5,265,366 A * 11/1993 Thompson ..... F41C 23/08 42/74
5,375,360 A * 12/1994 Vatterott ..... F41C 23/08 42/74

(Continued)

*Primary Examiner* — Michelle Clement
(74) *Attorney, Agent, or Firm* — Gerard E. Moy

(57) ABSTRACT

According to one embodiment, a recoil pad includes a base member configured to be mounted to a buttstock of a gun, and an amorphous material configured to be shaped into at least a portion of a cushion member. The amorphous material has a first surface configured to be physically coupled to the base member, and a second surface that is configured to be shaped around a portion of a shoulder of a user such that the second surface has a shoulder facing contour that matches a contour of the portion of the shoulder.

18 Claims, 14 Drawing Sheets

(56) References Cited

U.S. PATENT DOCUMENTS 5,471,776 A * 12/1995 Chesnut ..... F41C 23/08 42/74
5,555,584 A * 9/1996 Moore, III ..... A43B 7/28 12/142 N
5,669,168 A * 9/1997 Perry ..... F41C 23/08 42/104
6,301,817 B1 * 10/2001 Hogue ..... F41C 23/18 42/71.01
6,305,115 B1 * 10/2001 Cook ..... F41C 23/08 42/74
6,311,423 B1 * 11/2001 Graham ..... F41C 23/20 42/74
6,328,494 B1 * 12/2001 Moxon ..... B43K 5/005 15/443
6,467,212 B1 * 10/2002 Apel ..... F41C 23/08 42/74
6,594,935 B2 * 7/2003 Beretta ..... F41C 23/08 42/71.01
6,832,413 B1 * 12/2004 Applewhite ..... B25G 1/102 16/430
6,834,456 B2 * 12/2004 Murello ..... F41C 23/08 42/74
7,335,325 B1 * 2/2008 Pierson ..... B43K 23/008 264/223
8,192,813 B2 * 6/2012 Runyan ..... B32B 1/08 428/35.7
8,413,361 B2 4/2013 Quaedpeerds et al.
8,506,418 B2 * 8/2013 Tremulis ..... A63B 60/14 473/300
10,697,730 B2 * 6/2020 Brown ..... F41C 23/16
2001/0011434 A1 * 8/2001 Gussalli Beretta ..... F41C 23/08 42/74
2002/0088161 A1 * 7/2002 Sims ..... F41C 23/08 42/74
2002/0170224 A1 * 11/2002 Lawless ..... F41C 23/10 42/71.02
2003/0226304 A1 * 12/2003 Murello ..... F41C 23/08 42/74
2006/0157901 A1 * 7/2006 Vito ..... A43B 21/26 267/136
2006/0168869 A1 * 8/2006 Daul ..... F41C 23/08 42/74
2009/0178323 A1 * 7/2009 Fluhr ..... F41C 23/08 42/71.01
2010/0242333 A1 * 9/2010 Kincel ..... F41C 23/14 42/73
2010/0275482 A1 11/2010 Bentley
2011/0107642 A1 * 5/2011 Godard ..... F41C 23/10 42/71.01
2011/0113666 A1 * 5/2011 Latimer ..... F41C 23/08 42/74
2011/0173863 A1 * 7/2011 Ingram ..... F41C 23/14 42/74
2012/0144715 A1 * 6/2012 Simpson ..... F41C 23/20 42/74
2012/0167430 A1 * 7/2012 Freed ..... F41A 9/65 42/71.02
2012/0167432 A1 * 7/2012 Howe ..... B29C 33/308 42/74
2013/0174461 A1 * 7/2013 Ballard ..... F41C 23/20 42/74
2014/0109452 A1 4/2014 Baker
2014/0165443 A1 * 6/2014 Johnston ..... F41C 23/10 42/74
2014/0173812 A1 * 6/2014 Krueger ..... A41D 13/015 2/455
2014/0190055 A1 * 7/2014 Warburton ..... F41A 11/00 42/71.01
2014/0196336 A1 * 7/2014 Butler ..... F41C 23/08 42/1.06
2014/0259849 A1 * 9/2014 Jakele ..... F41C 23/22 42/74
2016/0010944 A1 * 1/2016 Downey ..... F41C 23/06 42/74
2016/0273874 A1 * 9/2016 Butler ..... F41C 23/08
2017/0122698 A1 * 5/2017 Chu ..... F41B 11/70
2018/0017354 A1 * 1/2018 Betteridge ..... F41C 23/08
2018/0321012 A1 * 11/2018 Bentley ..... F41A 35/06
2018/0335272 A1 * 11/2018 Heinz ..... F41C 23/20
2018/0335273 A1 * 11/2018 Doty ..... F41C 23/14
2019/0316873 A1 * 10/2019 Kronengold ..... F41C 23/14
2020/0282655 A1 * 9/2020 Plant ..... A43B 13/04
2020/0340778 A1 * 10/2020 Bryan ..... F41C 23/08

* cited by examiner

CLAY PIGEON SHOOTING SYSTEM AND METHOD OF USING THE SAME

CROSS REFERENCE TO RELATED APPLICATIONS

This application is related to and claims priority under 35 U.S.C. § 119 to U.S. Patent Application No. 62/761,365, filed Mar. 21, 2018 entitled "CLAY PIGEON SHOOTING SYSTEM AND METHOD OF USING THE SAME." Patent Application No. 62/761,365 is hereby incorporated by reference in its entirety.

TECHNICAL FIELD

Aspects of the present disclosure relate to clay pigeons and, in particular, to a clay pigeon shooting system and method of using the same.

BACKGROUND

Clay pigeon shooting, also known as clay target shooting, and formally known as Inanimate Bird Shooting, is the art of shooting a firearm at a type of flying targets commonly known as clay pigeons (e.g., clay targets). In this competitive genre of sport, clay pigeon shooters shoot at the clay pigeons that have been thrown from mechanisms commonly referred to as traps. Clay pigeon shooting may have over twenty different forms of regulated competition called disciplines, although most can be grouped under the main headings of trap, skeet, and sporting clays.

SUMMARY

According to one embodiment, a recoil pad includes a base member configured to be mounted to a buttstock of a gun, and an amorphous material configured to be shaped into at least a portion of a cushion member. The amorphous material has a first surface configured to be physically coupled to the base member, and a second surface that is configured to be shaped around a portion of a shoulder of a user such that the second surface has a shoulder facing contour that matches a contour of the portion of the shoulder.

According to another embodiment, a method includes mounting a base member to a buttstock of a gun, and shaping an amorphous material to form at least a portion of a cushion member having a first surface and a second surface such that the first surface is physically coupled to the base member, and the second surface is shaped around a portion of a shoulder of a user such that the second surface has a shoulder facing contour that matches a contour of the portion of the shoulder.

BRIEF DESCRIPTION OF THE DRAWINGS

The various features and advantages of the technology of the present disclosure will be apparent from the following description of particular embodiments of those technologies, as illustrated in the accompanying drawings. It should be noted that the drawings are not drawn to scale; however the emphasis instead is being placed on illustrating the principles of the technological concepts. Also, in the drawings the like reference characters refer to the same parts throughout the different views. The drawings depict only typical embodiments of the present disclosure and, therefore, are not to be considered limiting in scope.

DETAILED DESCRIPTION

Figure 1A:
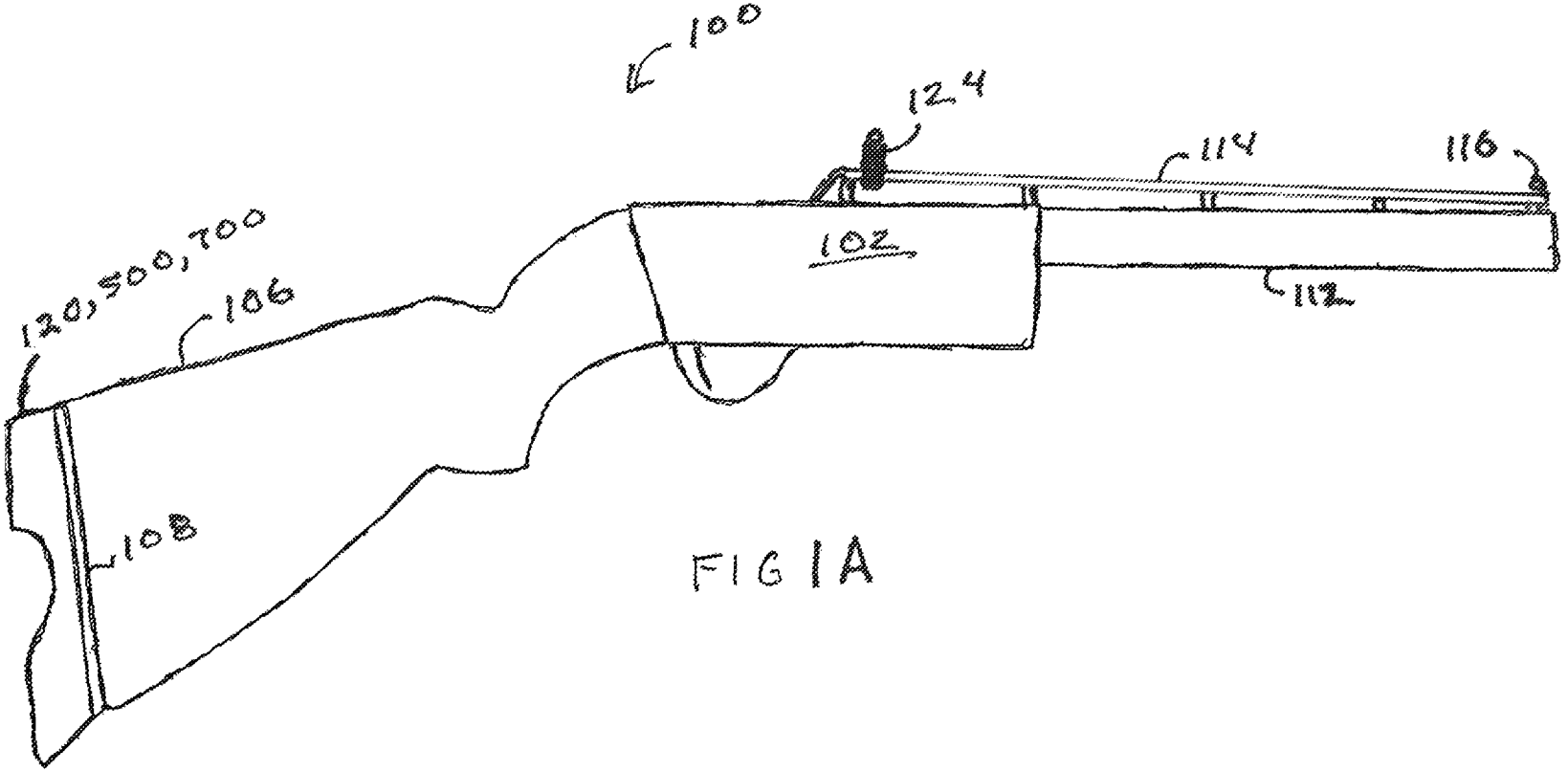
FIG. 1A illustrates an example clay pigeon shooting system according to certain embodiments of the present disclosure.

FIG. 1A illustrates an example clay pigeon shooting system 100 according to certain embodiments of the present disclosure. The clay pigeon shooting system 100 includes a shotgun 102 that may be used to fire shotgun loads at a target, which may be any suitable type, such as a clay pigeon used on a skeet range, trap range, or a sporting clay range. The shotgun 102 has a buttstock 106 with a rear end 108, a barrel 112, a rib 114, and a front sight 116. According to embodiments of the present disclosure, the shotgun 102 may be configured with a custom recoil pad 120', 120", 500, 700 and/or a rear sight 124 that may be used to, among other things, enhance the accuracy, comfort, and/or shooting enjoyment of a clay pigeon shooter.

Figure 1B:
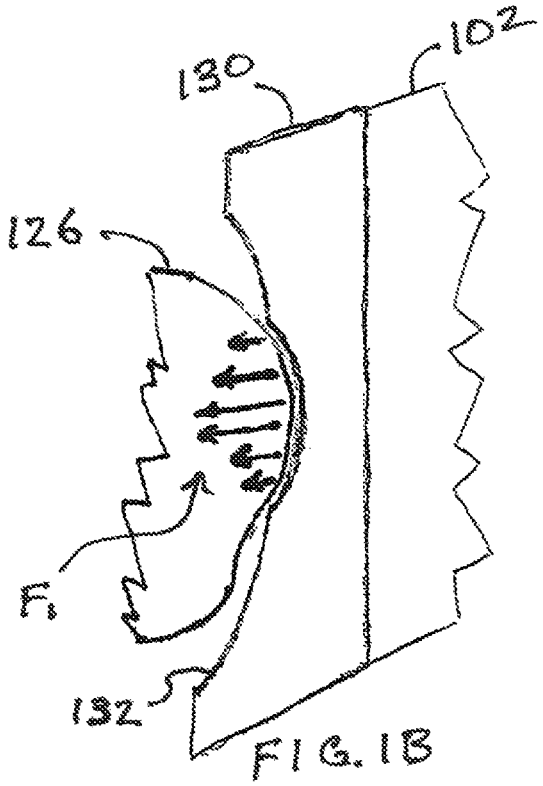
FIGS. 1B and 1C illustrate differences in how several example recoil pads may function when the shotgun of FIG. 1A is fired according to certain embodiments of the present disclosure.
Figure 1C:
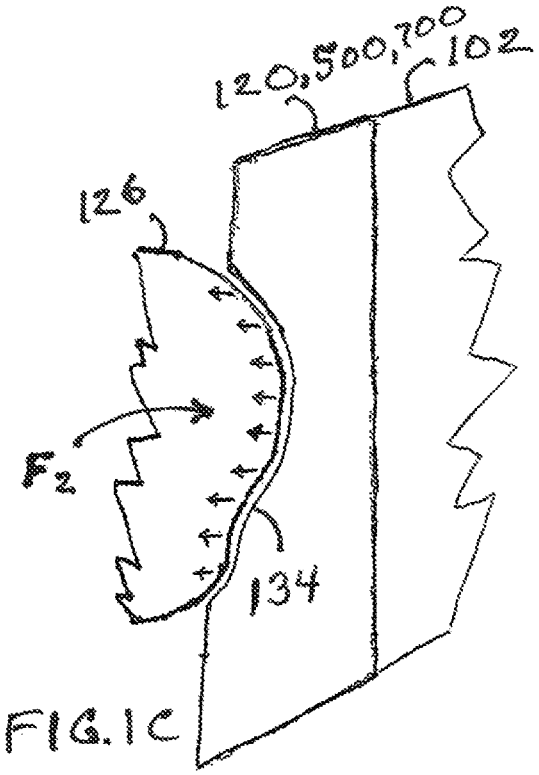

FIGS. 1B and 1C illustrate differences in how several example recoil pads may function when the shotgun 102 is fired according to certain embodiments of the present disclosure. In particular, FIG. 1B illustrates how a conventional recoil pad 130 may function when the shotgun 102 is fired, while FIG. 1C illustrates how the custom recoil pad 120, 500, 700 may function when the shotgun 102 is fired. In particular, FIG. 1B shows a distribution of forces $F_1$ that may be imparted upon a shoulder 126 of a clay pigeon shooter (e.g., user) when the shotgun 102 is fired using the conventional recoil pad 130, while FIG. 1C shows a distribution of forces $F_2$ that may be imparted upon the shoulder 126 of the user when the shotgun 102 is fired using the custom recoil pad 120', 120", 500, 700.

Many conventional recoil pads have been designed to optimize a recoil dampening (e.g., cushioning) effect that may be experienced by the clay pigeon shooter. For example, many users who compete in the clay shooting sports (e.g., skeet, trap, sporting clays, etc.) will often shoot their shotgun numerous times (e.g., over 100 times) during a single sporting event. This amount of shooting can, and often does, cause substantial stress upon the shoulder 126 of the user. As such, significant development efforts have been made to minimize recoil effects felt by the user.

Conventional techniques for recoil dampening have often involved optimizing an elasticity of the recoil pad to reduce or dampen the detrimental effects of recoil felt by the user. But even though substantial development efforts have been made, conventional recoil pads suffer in that their contour does not match that of the shoulder of a user. As shown in FIG. 1B, even though the example conventional recoil pad 130 may possess a shoulder facing contour 132 having a generic curvature (e.g., a factory provided curvature), it does not follow the contour of the user's shoulder 126. Thus, the generic conventional recoil pad 130 often generates a relatively high impact force $F_1$ at a relatively small region of the shoulder 126, thus yielding a relatively high level of impact force at this localized region.

Conversely as shown in FIG. 1C, the example custom recoil pad 120', 120", 500, or 700 constructed according to certain embodiments of the present disclosure has a shoulder facing contour 134 that generally follows the contour of the shoulder 126 to a relatively good degree such that the recoil impact force $F_2$ is distributed across the shoulder 126 of the user. Thus, the relatively high, localized impact force $F_1$ that would otherwise be imparted onto a small region of the user's shoulder 126 using the conventional recoil pad 130 is reduced. Moreover, because the relatively high localized impact force $F_1$ is reduced, physical soreness and/or shoulder strain often attributed to numerous impact force events caused by repeated firings of the shotgun may also be reduced. Whereas conventional recoil pads may have possessed a curved contour, this contour was merely semi-circular or semi-oval in shape and not contoured to the shape of the shoulder of the human body, which is neither semi-circular nor semi-oval in shape. Embodiments of the present disclosure provide a recoil pad 120', 120", 500, or 700 having a contour specifically adapted around the contour of the shoulder of the body that may provide one or more advantages, which may include for example, enhanced distribution of recoil force across the shoulder area, consistent positioning of the buttstock 106 on the shoulder of the clay pigeon shooter, and the like.

Every user's shoulder contour (e.g., curvature) may be unique to that individual for various reasons. For example, differences in the overall size and mass of the user's skeletal structure may cause the shoulder's contour of that user to be different from other users. As another example, differences in lifestyle habits, such as exercise habits and/or dietary habits, may cause the shoulder's contour of that user to be different from other users. Thus fabricating a recoil pad with a generic contour that adequately conforms to the unique contour of each user's shoulder has been a relatively difficult endeavor. This problem is exacerbated due to the relatively high, localized impact forces imparted onto certain portions of the muscular structure of the shoulder, such as the deltoideous muscle that is also used to aid in controlling the positioning and firing of the shotgun 102. Thus, as muscle fatigue of such muscles increases due to repeated high, localized impact forces caused by recoil, positioning and firing consistency of the user also diminishes. Embodiments of the present disclosure may provide a solution to these problems, among other problems, using a custom recoil pad 120', 120" with a shoulder facing contour 134 that is customized to match that of the user's shoulder contour so that the relatively high, localized impact forces commonly associated with recoil may be reduced.

Figure 2A:
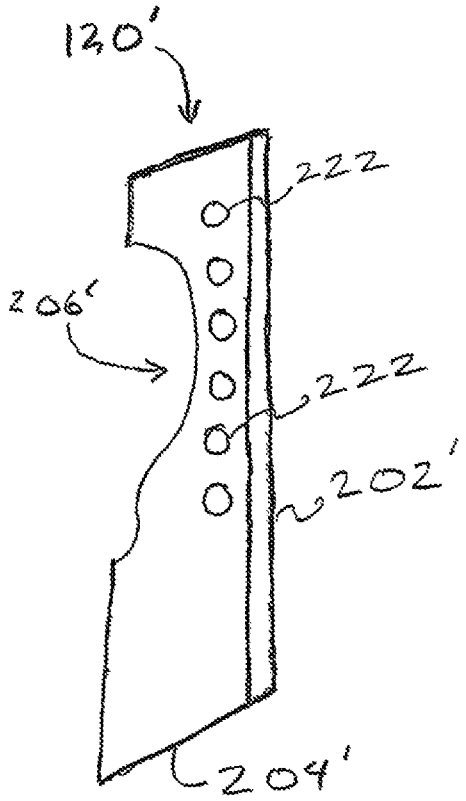
FIGS. 2A and 2B illustrate example recoil pads according to embodiments of the present disclosure.
Figure 2B:
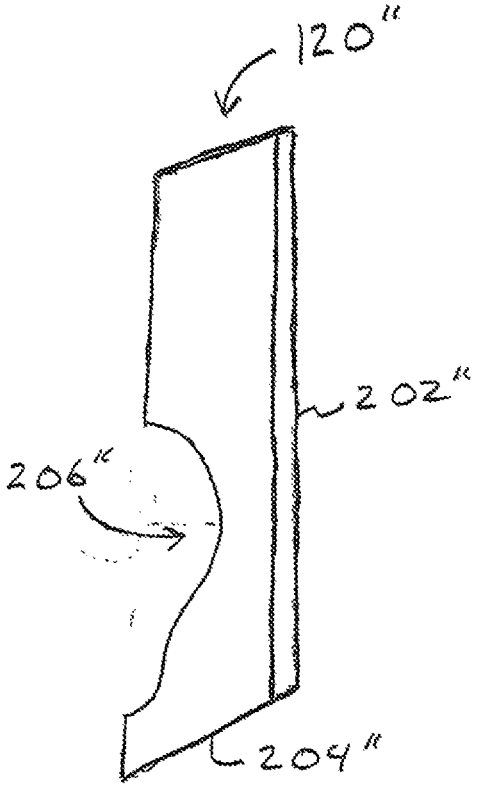

FIGS. 2A and 2B illustrate several example recoil pads 120', 120" according to certain embodiments of the present disclosure. Each recoil pad 120', 120" includes a base member 202', 202" and a cushion member 204', 204" that is custom fitted to a shoulder of a clay pigeon shooter. As will be shown and described in detail herein below, the cushion member 204', 204" may be shaped (e.g., formed) from uncured mold material that is pressed into a mold while the clay pigeon shooter presses their shoulder onto the recoil pad 120', 120" such that, when cured, the cushion member 204', 204" cures into a shoulder facing contour 206', 206" (e.g., outer shape) that matches a contour of the shoulder of the clay pigeon shooter. Additionally, the mold may be adjustable such that the shoulder facing contour 206', 206" formed in the recoil pad 120', 120" may be formed at any suitable location on the recoil pad 120', 120". For example, the recoil pad 120' of FIG. 2A is shown with the contour 206' relatively close to the upper end of the recoil pad 120', while the recoil pad 120" of FIG. 2B is shown with the contour 206" relatively close to the lower end of the recoil pad 120".

Figure 3:
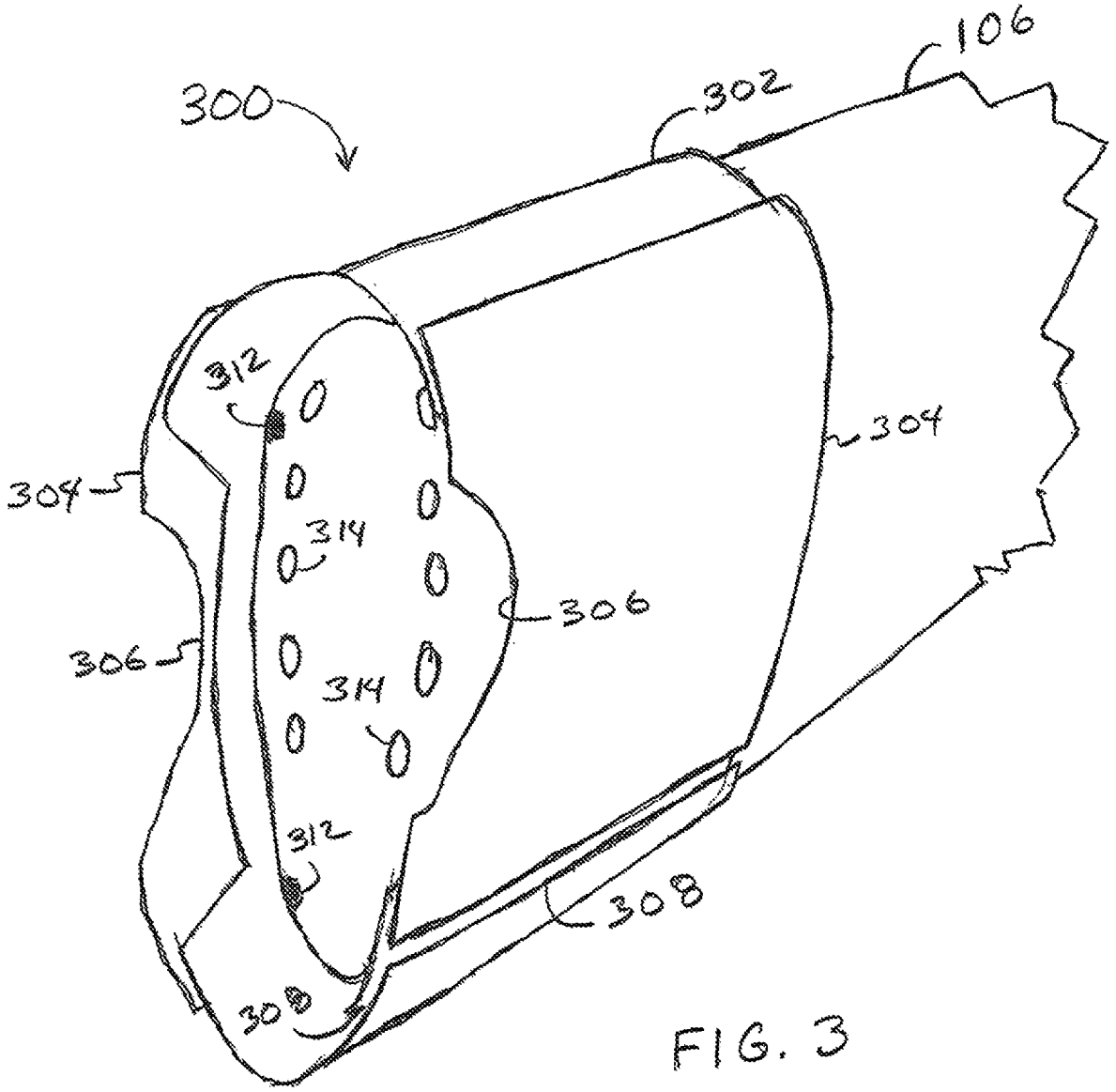
FIG. 3 is a perspective view illustrating an example mold that may be used to form either of the recoil pads according to embodiments of the present disclosure.

FIG. 3 is a perspective view illustrating an example mold 300 that may be used to form either of recoil pad 120', 120" according to embodiments of the present disclosure. The mold 300 include a base portion 302 and two shoulder recess portions 304 configured on both sides of the base portion 302. Each shoulder recess portion 304 includes an edge 306 that approximates the shoulder contour of the clay pigeon shooter. The shoulder recess portions 304 are movably secured to the base portion 302 in any suitable manner. For example, the shoulder recess portions 304 may be secured to the base portion 302 using screws configured in slots that allow the shoulder recess portions 304 to be set to a desired position. As another example, the shoulder recess portions 304 may be movably secured to the base portion 302 using a strap, such as a screw band clamp (e.g., hose clamp), that allows the shoulder recess portions 304 to be moved relative to the base portion 302 and then locked in place when the strap is tightened. Using screws, a strap, or any other suitable securing mechanism, the shoulder recess portions 304 may be secured at different positions and/or orientations relative to the base portion 302 so that a recoil pad 120', 120" formed from the mold 300 may have a shoulder facing contour formed at a desired position. For example, one clay pigeon shooter may desire to position their shoulder near the upper end of the recoil pad as shown in FIG. 2A, while another clay pigeon shooter may desire to position their shoulder near the lower end of the recoil pad as shown in FIG. 2B. As another example, one clay pigeon shooter may desire to position their shoulder such that the shotgun, when mounted on the clay pigeon shooter's shoulder is in a substantially vertical position (e.g., the trigger of the shotgun is substantially below the barrel), while another clay pigeon shooter may desire to position their shoulder on the recoil pad 120', 120" such that the shotgun, when mounted, is oriented at an angle relative to the vertical position (e.g., the trigger of the shotgun is positioned at a 12 degree angle beneath, and to the side of the barrel). Thus, by adjusting the shoulder recess portions 304, the position and/or orientation of the contour 206', 206" may be customized as desired by the clay pigeon shooter.

The contour of the edges 306 of the shoulder recess portions 304 may be shaped to generally conform to the shape of some, most, or all clay pigeon shooters. Moreover, specific dimensions of the contour of the edges 306 may be selected so that the contour 206', 206" of the recoil pad 120', 120" will at least mostly be set using the shape of the clay pigeon shooter's shoulder contour, while the edges 306 mostly provide a bounding surface along the sides of the recoil pad 120', 120" for the amorphous uncured mold material when inserted into the mold 300.

The mold 300 may be made of any suitable material, such as metal, plastic, or other suitable material. In one embodiment, the mold 300 may be formed of a sheet of suitable material having two ends 308. The material is wrapped around the end 108 of the buttstock 106 such that the two ends 308 overlap. The mold material may then be secured to the end 108 of the buttstock 106 using any suitable securement mechanism, such as a hose clamp that compresses the mold 300 against the end 108 of the buttstock 106.

In one embodiment, the mold 300 is configured with tabs 312 that project inwards when mounted on the buttstock 106, and lie adjacent to the base portion 202', 202" or the end 108 of the buttstock 106 to fix the position and orientation of the mold 300 relative to the position and orientation of the buttstock 106.

In another embodiment, the base member 202', 202" may include holes 314 that function as undercuts so that when amorphous mold material is introduced into the mold 300, a portion of the mold material may be pushed into the holes 314 for securing the cushion member 204', 204" to the base member 202', 202". Although not shown, other mechanisms may be used for securing the cured cushion member 204', 204" to the base member 202', 202". For example, the base member 202', 202" may be configured with tabs or other features with undercuts that extend above the surface of the base member 202', 202" so that when the amorphous mold material is introduced into the mold 300, the mold material may encompass the tabs or features for securing the cushion member 204', 204" to the base member 202', 202".

Figure 4:
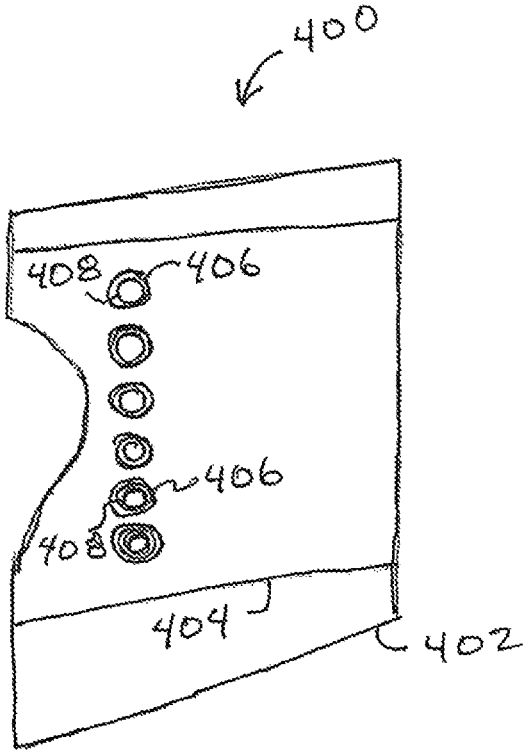
FIG. 4 is a side elevational view illustrating another example mold that may be used to form the recoil pad according to embodiments of the present disclosure.

FIG. 4 is a side elevational view illustrating another example mold 400 that may be used to form the recoil pad 120', 120" according to certain embodiments of the present disclosure. The mold 400 includes a base portion 402 and two shoulder recess portions 404 that are similar in design and construction to the base portion 302 and shoulder recess portions 304 of the mold 300 of FIG. 3. The mold 400 of FIG. 4 differs, however, in that the shoulder recess portions 404 include holes 406 on both sides for insertion of rods 408. Thus, the rods 408 extend through the mold cavity such that, when the mold material is inserted into the mold 400 and cured, the rods 408 form complementary holes 222 in the resulting recoil pad 120' as best shown in FIG. 2A. The holes in the recoil pad may be useful for effective softening or dampening of the cured cushion member 204', 204". For example, if the cured mold material has a nominal Shore A hardness of 35, then the holes may cause the cushion member 204', 204" to have a relatively lower apparent hardness (e.g., 15-25 Shore A hardness) when the shotgun 102 is fired.

Although several example recoil pads 120', 120" have been shown and described herein, it should be understood that other recoil pads may be embodied in other specific forms without departing from the spirit and scope of the present disclosure. For example, the cushion member may be formed without the use of a mold, such as by generally forming a specified amount of uncured amorphous mold material on the base member 702, and forming the shoulder contour in the uncured mold material. After the mold material has been cured, portions of it may be machined (e.g., grinded) such that the resulting side edges (e.g., cross-sectional shape) of the recoil pad 120', 120" is generally similar to that of the rear end 108 of the buttstock 106.

Figure 5:
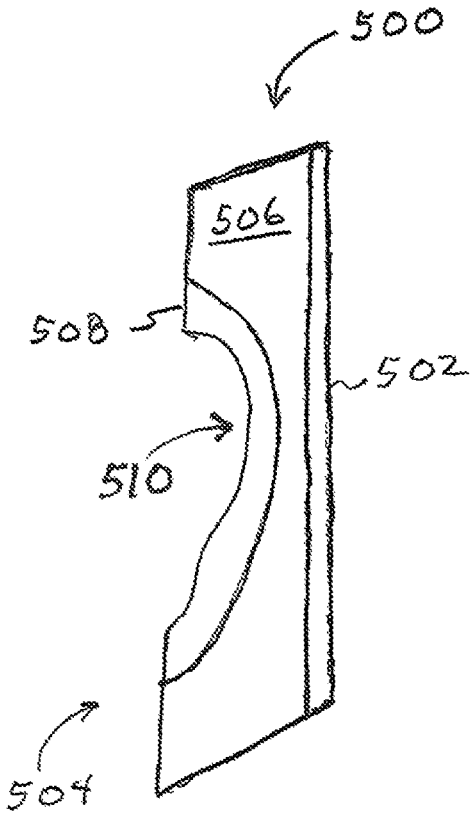
FIG. 5 illustrates another example recoil pad according to embodiments of the present disclosure.

FIG. 5 illustrates another example custom recoil pad 500 according to one embodiment of the present disclosure. The custom recoil pad 500 has a base member 502 that is similar in design and construction to the base member 202', 202" of FIGS. 2A and 2B. The custom recoil pad 500 differs, however, in that the custom recoil pad 500 includes a cushion member 504 having an pre-cured (e.g., inner) portion 506 of cured mold material and a user-cured (e.g., outer) portion 508 of cured mold material with a shoulder facing contour 510 that has been customized to match that of the shoulder of the clay pigeon shooter. Such a configuration may be useful for providing a kit to a clay pigeon shooter in which the pre-cured portion 506 has been previously cured prior to acquisition by the clay pigeon shooter, while the user-cured portion 508 may be shaped by the clay pigeon shooter so that the resulting cushion member 504 may be customized to the clay pigeon shooter's shoulder contour, while reducing the amount of mold material to be cured by the clay pigeon shooter in certain embodiments.

The pre-cured portion 506 generally refers to a portion of the cushion member 504 that is cured prior to the user-cured portion 508 being cured, while the user-cured portion 508 generally refers to that portion of the cushion member 504 that is cured by the clay pigeon shooter when shaped to match the contour of the clay pigeon shooter's shoulder. For example, the custom recoil pad 500 may be provided through a retail outlet as a kit that includes, among other things, a previously made assembly including a base member 502 and a pre-cured portion 506 that have been made (e.g., shaped and cured) by a manufacturer. The kit may also include a specified amount of amorphous hardening material, such as a two-part elastomeric polymer. Upon acquisition, the clay pigeon shooter may mix (e.g., stir, knead, etc.) and then shape the elastomeric polymer on the pre-cured portion 506 to conform to their shoulder's contour.

Certain embodiments including a pre-cured portion 506 and a user-cured portion 508 may provide certain advantages not heretofore recognized by conventional recoil pads. For example, the clay pigeon shooter may be alleviated of the complexity of forming the shape of the entire cushion member 504. Additionally, the cushion member 504 may be formed with portions having different or the same hardness. For example, the pre-cured portion 506 may be made of a material having a Shore A hardness of 40, while the user-cured portion 508 may be formed of a material having a Shore A hardness of 30. As another example, the pre-cured portion 506 and the user-cured portion 508 may both be made of a material having a Shore A hardness of 30. Other combinations of hardness levels may exist for tailoring the level and type of recoil suppression and/or durability desired by the clay pigeon shooter.

Figure 6A:
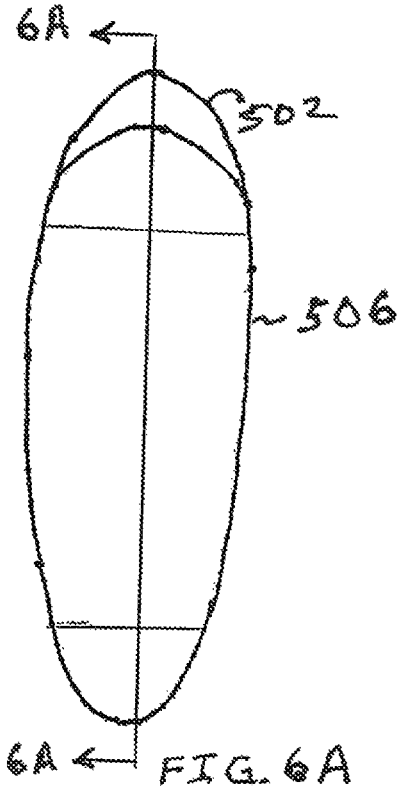
FIGS. 6A through 6F illustrate an example process that may be used to make the custom recoil pad as shown in FIG. 5.
Figure 6B:
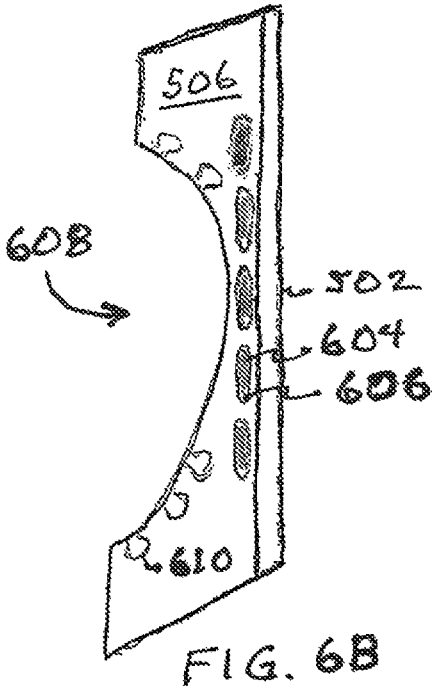

FIGS. 6A through 6F illustrate an example process that may be used to make the custom recoil pad 500 as shown in FIG. 5. In particular, FIG. 6A illustrates a rear view of the base member 502 and pre-cured portion 506 of the custom recoil pad 500, while FIG. 6B illustrates a side, cut-away view taken along the line 6A-6A of FIG. 6A of the custom recoil pad 500 according to certain embodiments of the present disclosure. The pre-cured portion 506 includes rods 604 configured in complementary holes 606, and a concave surface 608 that will be described in detail herein below.

In some embodiments, the base member 502 and pre-cured portion 506 may both be grindable (e.g., machinable) so that their outer cross-sectional shape may be grinded or otherwise machined in order to conform to the cross-sectional shape of the rear end 108 of the buttstock 106 of the shotgun 102. The cross-sectional shape of the recoil pad 500 generally refers to a shape of an outer sidewall of the recoil pad 500 that in this particular instance, is generally oval in shape. Shotguns often have buttstocks with cross-sectional shapes and sizes that differ from one another. Thus, the base member 502 and pre-cured portion 506 may be provided with a cross-sectional shape and size that can be grinded in order to conform to or otherwise be similar to the cross-sectional shape of the buttstock of the shotgun.

As shown, the pre-cured portion 506 may be provided to the clay pigeon shooter in a pre-cured form, while the user-cured portion 504 is provided in an amorphous un-cured form (e.g., shapeable, hardening putty). The pre-cured portion 506 includes a concave surface 608 that is adapted to receive the un-cured amorphous material on its surface. In one embodiment, the pre-cured portion 506 is configured with undercut recesses 610 along its concave surface 608 so that, when the amorphous material is pressed onto the concave surface 608 of the pre-cured portion 506, a portion of the un-cured material may enter the undercut recesses 610, and interlock with the pre-cured portion 506 for enhanced adhesion or binding of the user-cured portion 508 to the pre-cured portion 506 when the user-cured portion 508 has cured. As shown, the undercut recesses 610 generally include depressions whose entrance is smaller than its width. Nevertheless, it is contemplated that the concave surface 608 may be fashioned with other types of features for enhanced coupling of the pre-cured portion 506 to the user-cured portion 508 when cured. For example, it is contemplated that the concave surface 608 may be fashioned with loops (e.g., similar to the loops found on hook-and-loop fastening material) configured along the concave surface 608 that interlock with the amorphous material when pressed onto the concave surface 608. For another example, a layer of a suitable binding agent (e.g., liquid adhesive, surface etching agent, etc.) may be applied to the surface of the concave surface 608 prior to pressing the amorphous material onto its surface.

In one embodiment, the custom recoil pad 500 may be made with multiple user-cured portions 504 that can each be releasably secured onto the pre-cured portion 506 of the custom recoil pad 500. The releasable securement is provided by the undercut recesses 610 that allow the user-cured portion 504 to be pressed (e.g., snapped) onto the surface of the pre-cured portion 506 with a releasably locking fit. The user-cured portion 504 may be removed from the pre-cured portion 506 by physically pulling the user-cured portion 504 away from the pre-cured portion 506. Advantages provided by certain embodiments may include providing a recoil pad 500 with multiple user-cured portions 504 that can each be custom fitted to the clay pigeon shooter at differing times of the year (e.g., winter, summer, etc.) when body contours may change. Additionally, each of the multiple user-cured portions 504 may be custom fitted to different clay pigeon shooters so that the recoil pad 500 may be adapted for use with multiple clay pigeon shooters. Each of the multiple user-cured portions 504 may also be custom fitted to a clay pigeon shooter at ongoing intervals (e.g., every 2 years) so that the recoil pad 500 may be continually customized according to ongoing changes in that clay pigeon shooter's physique in some embodiments.

Figure 6C:
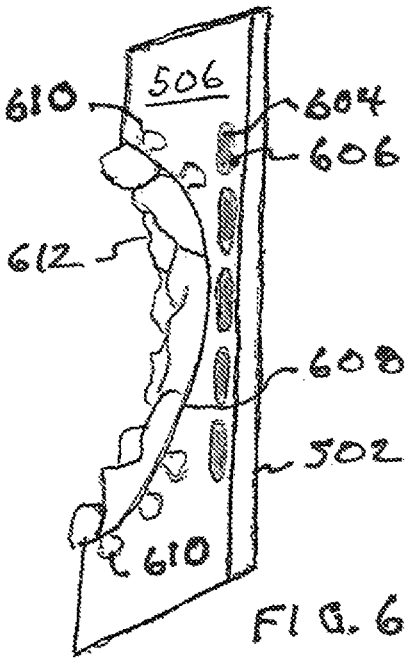

FIG. 6C illustrates a side, cut-away view taken along the line 6A-6A of FIG. 6A of the custom recoil pad 500 with a layer of amorphous material 612 placed on the concave surface 608 of the pre-cured portion 506. As shown, a portion of the amorphous material 612 has been pressed into the undercut recesses 610 so that the amorphous material 612 may interlock with the pre-cured portion 506 when the amorphous material 612 cures. The amorphous material 612 may be placed on the pre-cured portion 506 in any suitable manner. In a particular embodiment in which the amorphous material comprises two-part silicone putty, both parts of the silicone putty may be mixed (e.g., kneaded) prior to pressing the amorphous material 612 onto the pre-cured portion 506.

The amorphous material 612 may have any suitable un-cured viscosity (e.g., viscosity prior to curing) with a sufficient plasticity to generally maintain its shape once formed. In one embodiment, the amorphous material 612 may have a paste-like consistency that can be stirred using a suitable tool (e.g., mixing blade, blender, etc.), and applied to the concave surface 608 using a suitable applicator (e.g., brush, knife, etc.). In a particular example, the amorphous material 612 may be a two-part cure silicone material having a mixed viscosity of approximately 250,000 to 650,000 centipoise.

Figure 6D:
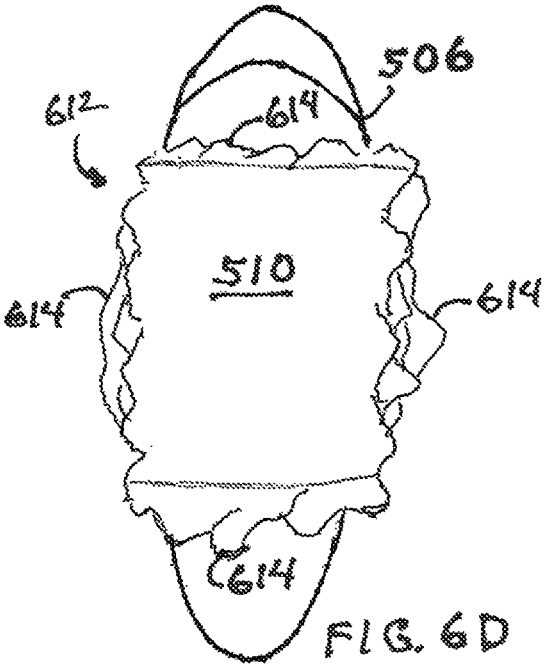

FIG. 6D illustrates a rear view of the custom recoil pad 500 with the layer of amorphous material 612 pressed onto the concave surface 608, and having a shoulder facing contour 510 formed in the amorphous material 612 according to certain embodiments of the present disclosure. In general, the shoulder facing contour 510 is formed in the amorphous material 612 as a result of pressing the custom recoil pad 500 against the shoulder 126 of the clay pigeon shooter until the shoulder facing contour 510 follows the contour of the shoulder 126. That is, the recoil pad 500 may be pressed against the shoulder of the clay pigeon shooter so that the amorphous material 612 is squeezed to form the shoulder facing contour 510 and excess amorphous material 612 is produced as buildup 614 along the edges of the shoulder facing contour 510.

In one embodiment, the base member 502, pre-cured portion 506 combination may be mounted onto the buttstock 106 of the shotgun 102 prior to the amorphous material 612 being applied to the pre-cured portion 506. Thus, the shotgun 102 and base member 502, pre-cured portion 506 combination may be mounted on the shoulder 126 of the clay pigeon shooter as is typically performed when firing the shotgun 102 for optimal fitting of the custom recoil pad 500 to the shoulder 126 of the clay pigeon shooter. In many cases, the contour of the shoulder will change based upon the relative position and orientation of the body elements, such as the torso and arm connected to the shoulder. For example, the shoulder may have a first contour when the arm is resting at the side of the torso, and a second different contour when the arm is raised due to various reasons including an extension/contraction level of the deltoidius and/or pectoralic major muscles based upon the relative position and orientation of that arm. Thus, it may be beneficial to match the shoulder facing contour 510 of the recoil pad 500, when the recoil pad 500 is mounted on the shotgun 102 and the clay pigeon shooter has mounted the shotgun 102 in a normal shooting position. For example, when the amorphous material 612 is applied to the pre-cured portion 506, the clay pigeon shooter may mount the shotgun 102 in a shooting position typically used, and physically pressing the base member 502, pre-cured portion 506 combination onto the shoulder 126 such that the amorphous material 612 is squeezed in order to form a shoulder facing contour 510 that matches the shoulder 126 of the clay pigeon shooter to a relatively close degree.

As shown, when the shoulder facing contour 510 is formed in the amorphous material 612, excess buildup 614 (e.g., overflow) of the amorphous material 612 may occur around the edges of the pre-cured portion 506 in some cases. For example, the excess buildup 614 may occur due to the pressing action of the custom recoil pad 500 against the shoulder 126 of the clay pigeon shooter in order to form the shoulder facing contour 510.

Figure 6E:
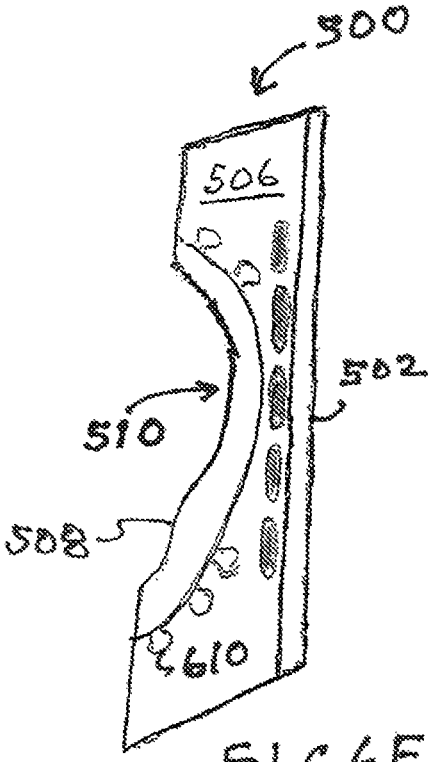

FIG. 6E illustrates a side, cut-away view taken along the line 6A-6A of FIG. 6A of the custom recoil pad 500 with the excess buildup 614 of amorphous material 612 removed in order to form the user-cured portion 508 of the custom recoil pad 500. The excess buildup 614 may be removed in any suitable manner. In one embodiment, the excess buildup 614 may be removed using a knife, such as a single-ended razor blade, that is drawn along the sides of the outer member 506 of the custom recoil pad 500.

Figure 6F:
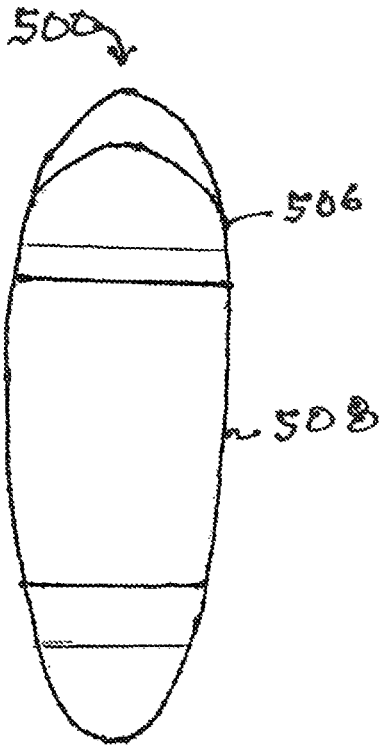

FIG. 6F illustrates a rear view of the completed custom recoil pad 500 as shown in FIG. 6E according to certain embodiments of the present disclosure. At this point, the amorphous material 612 has cured to form the user-cured portion 508 having a shoulder facing contour 510 along its surface that matches the contour of the shoulder 126 of the clay pigeon shooter to a relatively good degree, and is ready for use in shooting the shotgun 102.

As described previously, the custom recoil pad 500 may be configured with rods 604 (see FIG. 6B) that can be selectively removed to tailor or otherwise customize the effective stiffness at various locations along the extent of the custom recoil pad 500. For example, if a particular rod 604 is removed from its associated hole 606 in the custom recoil pad 500, the effective stiffness at that location may be reduced by allowing the hole 606 to at least partially collapse under the impact forces caused by recoil of the shotgun 102. Conversely, if the rod 604 remains in the custom recoil pad 500, the hole 606 may be inhibited from at least partially collapsing due to the presence of the rod 604, thus maintaining the effective stiffness at that location.

In some embodiments, the rods 604 may be selectively removed from certain holes 606 in order to adjust the effective stiffness at various locations along the custom recoil pad 500. For example, a clay pigeon shooter having recently undergone shoulder surgery may be experiencing a sharp, painful sensation at the top of their shoulder. In such a case, the rods 604 proximate the top of the custom recoil pad 500 may be removed so that the top portion of the custom recoil pad 500 is effectively softened, while the brunt of impact recoil force is borne by the lower portion of the custom recoil pad 500. In some cases, when the painful sensations cease, the rods 604 may be re-inserted into their respective holes 606 as needed. Similar scenarios may be performed to reduce and/or increase the effective stiffness at other regions (e.g., middle, bottom, etc.) of the custom recoil pad 500.

As shown, the rods 604 have a generally oval cross-sectional shape, and are arranged in a single row between the base member 502 and the user-cured portion 508. Nevertheless, it is contemplated that the rods 604 may have any suitable shape (e.g., rectangular, triangular, circular, etc.), and be arranged in any quantity of rows, such as two, three, or four or more rows. Additionally, it is contemplated that the rods 604 may be arranged in any suitable pattern (e.g., random spacing and orientation, alternating triangular pattern, etc.) without departing from the spirit and scope of the present disclosure.

Any suitable type of mold material may be used for generating the pre-cured portion 506, user-cured portion 508, or cushion member 204', 204" as shown and described in FIGS. 2A and 2B. For a particular example, the pre-cured portion 506 may be made of two-part polyurethane elastomeric polymer (e.g., mold rubber) material having a liquid consistency prior to curing, and an elastomeric hardness of Shore A 50 when cured. For another particular example, the user-cured portion 508 may be made from a two-part silicone polymer material having a putty-like, shapeable consistency prior to curing, and an elastomeric hardness of Shore A 40 when cured. In some cases, a two-part silicone polymer material may be beneficial due to its relatively low toxicity level to human skin. Other examples of suitable types may include one part cure silicone, two-part cure polymer foam, one part cure polymer open cell foam, two part cure closed cell foam, viscoelastic urethane, polystyrene, a shape memory polymer (SMP), or any combination thereof. In some cases, the shape memory polymer material may be useful for making (e.g., shaping) the user-cured portion 508 in a manner that can be repeatedly shaped as the shoulder contour of the clay pigeon shooter changes over time.

Additionally, the base member 202', 202", and 502 may be made from any suitable material, such as polyethylene, acrylonitrile butadiene styrene (ABS), aluminum, steel, or other suitable material. In a particular example, the base member 202', 202", and 502 may be formed from an aluminum alloy plate having a thickness of approximately 0.1875 inches. In another particular example, the base member 202', 202", and 502 may comprise a first plate and a second plate formed of a machinable (e.g., grindable) material, such as plastic. The first plate being coupled to the pre-cured portion 506 or cushion member 204', 204" and having a standard mounting hole pattern. The second plate has a first set of holes with the standard mounting hole spacing to accommodate mounting to the first plate using screws, and a region whereby a second set of holes may be drilled by the clay pigeon shooter to accommodate a unique hole spacing of the buttstock 106 of the shotgun 102. Such an arrangement may be useful for cases where the base member 502 may be used to mount to buttstocks having different mounting hole patterns relative to one another.

Although FIGS. 6A through 6F illustrate one or more particular embodiments of how to make the custom recoil pad 500, it should be appreciated that the custom recoil pad 500 may be made using fewer, different, or additional steps than what is described herein. For example, mixing (e.g., kneading) of the amorphous material 612 may not be necessary if a 1-part material is used. As another example, the excess buildup 614 may be removed at any time after the shoulder facing contour 510 is formed in the amorphous material 612, such as before the amorphous material 612 has cured. As yet another example, the rods 604 and/or their associated holes 606 may be omitted from the custom recoil pad 500 if not needed or desired. As yet another example, although the cushion member 504 of FIG. 5 is shown and described with two layers, it should be appreciated that the cushion member 504 may include greater than two layers, such as three or more layers.

Figure 7A:
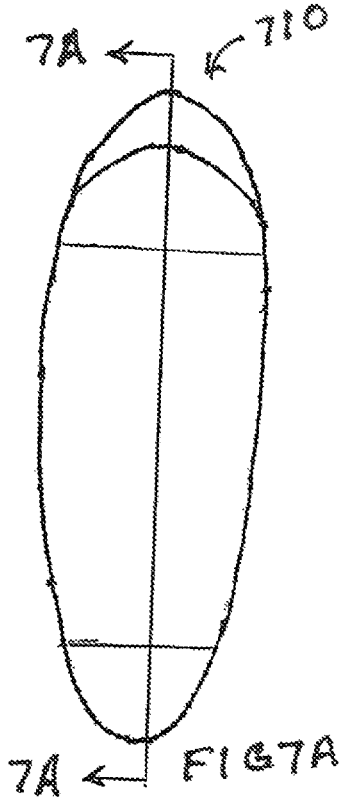
FIGS. 7A through 7H illustrate an example custom recoil pad and an associated process that may be performed to make the custom recoil pad according to certain embodiments of the present disclosure.
Figure 7B:
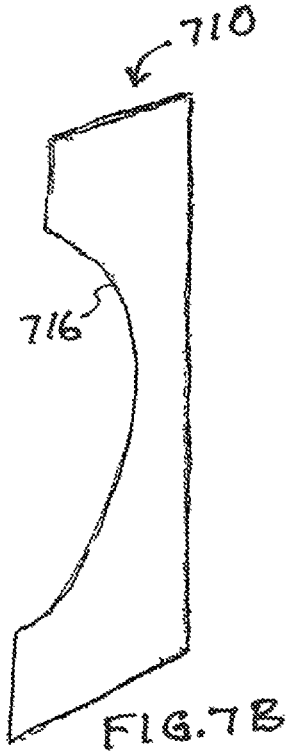
Figure 7C:
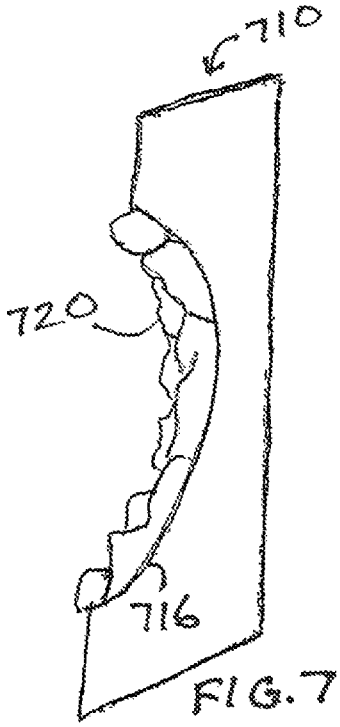
Figure 7D:
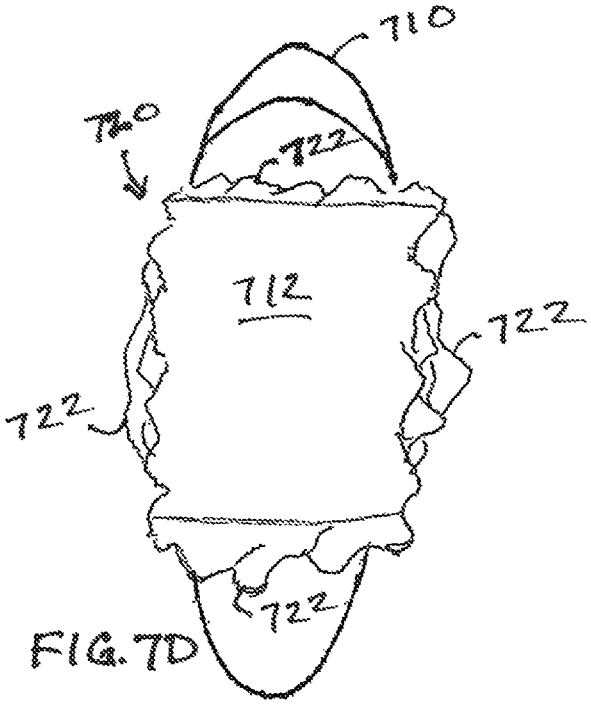
Figure 7E:
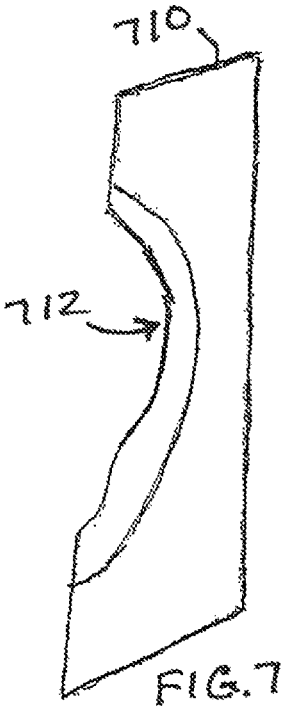
Figure 7G:
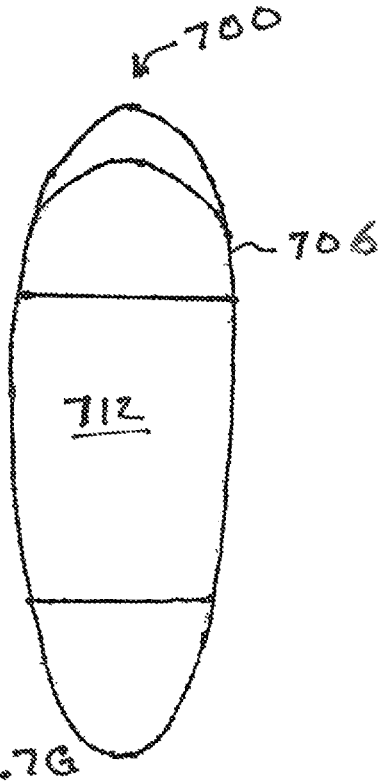
Figure 7F:
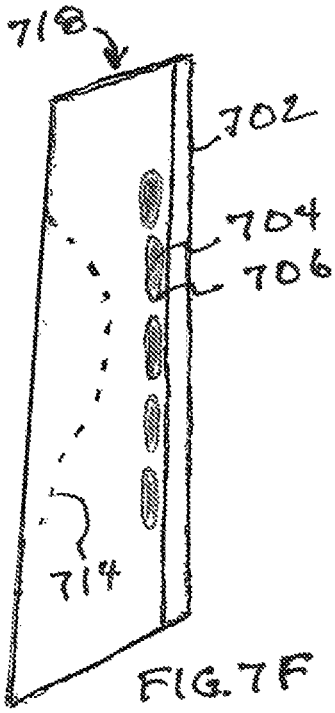
Figure 7H:
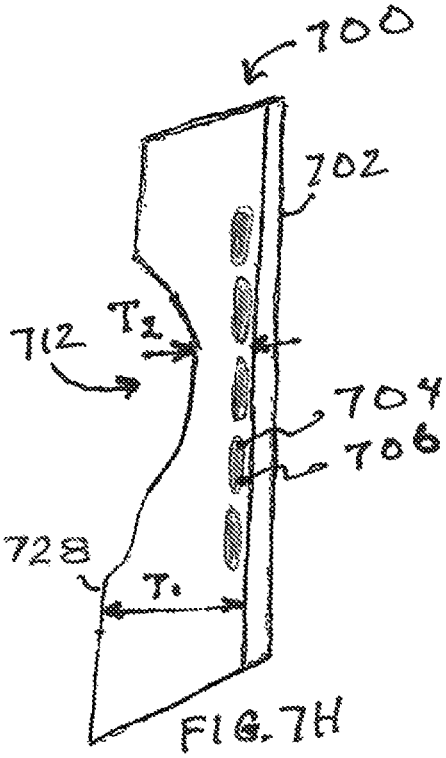

FIGS. 7A through 7H illustrate an example custom recoil pad 700 and an associated process that may be performed to make the custom recoil pad 700 according to certain embodiments of the present disclosure. In particular, FIGS. 7G and 7H illustrate a rear view and a side view, respectively, of the custom recoil pad 700, while FIGS. 7A through 7F illustrate how various elements may be used to make the custom recoil pad 700. The custom recoil pad 700 has a base member 702 and rods 704 configured in holes 706 that are similar in design and construction to the base member 502, rods 604, and holes 606 of the custom recoil pad 500. The custom recoil pad 700 differs, however, in that it has a cushion member 728 formed from a single piece of soft material (e.g., silicone, closed cell foam, polyurethane, Sorbothane™, etc.) that can be cut using a suitable tool, such as a scroll saw, a coping saw, and the like, to form a shoulder facing contour 712 that matches the contour of the clay pigeon shooter's shoulder. In some embodiments, the base member 702 and cushion member 728 may both be grindable (e.g., machinable) so that the outer perimeter may be grinded or otherwise machined in order to conform to the cross-sectional shape of the buttstock 106 of the shotgun 102.

FIG. 7A illustrates a rear view of a contour gauge 710, while FIG. 7B illustrates a side, cut-away view taken along the line 7A-7A of FIG. 7A of the contour gauge 710 according to certain embodiments of the present disclosure. In general, the contour gauge 710 is used to generate a contour marking line 714 (see FIG. 7F) representing a shoulder contour of the clay pigeon shooter. Once generated, the contour marking line 714 may be transferred to a blank recoil pad 718 (see FIG. 7F), and the blank recoil pad 718 cut along the contour marking line 714 in order to form the custom recoil pad 700. Referring again to FIGS. 7A and 7B, the contour gauge 710 includes a concave surface 716 and is formed from a generally rigid material that can be temporarily mounted onto the buttstock 106 of the shotgun 102.

In this disclosure, the term 'blank recoil pad' generally refers to a type of recoil pad on which no custom shoulder facing contour has yet been imparted. In one embodiment, the blank recoil pad 718 may have grindable sidewalls so that it may be machined or otherwise grinded to have a cross-sectional shape similar to the cross-sectional shape of the buttstock of the shotgun.

FIG. 7C illustrates a side, cut-away view taken along the line 7A-7A of FIG. 7A of the contour gauge 710 with a layer of non-hardening amorphous material 720 (e.g., modeling clay, etc.) pressed onto the concave surface 716 of the contour gauge 710. The concave surface 716 may have a texture and consistency such that the non-hardening amorphous material 720 sticks or otherwise temporarily adheres to the concave surface 716.

FIG. 7D illustrates a rear view of the contour gauge 710 with the layer of non-hardening amorphous material 720 pressed onto the concave surface 716, and having a shoulder facing contour 712 formed in the non-hardening amorphous material 720 according to certain embodiments of the present disclosure. In general, the shoulder facing contour 712 is formed in the non-hardening amorphous material 720 as a result of pressing the contour gauge 710 against the shoulder 126 of the clay pigeon shooter until the shoulder facing contour 712 follows the contour of the shoulder 126.

The contour gauge 710 may be mounted onto the buttstock 106 of the shotgun 102 prior to the non-hardening amorphous material 720 being applied to the concave surface 716. Thus, the shotgun 102 and contour gauge 710 may be mounted on the shoulder 126 of the clay pigeon shooter as is typically performed when firing the shotgun 102 for generating a contour marking line 714 that optimally matches the shoulder 126 of the clay pigeon shooter. For example, when the non-hardening amorphous material 720 is applied to the concave surface 716, the clay pigeon shooter may mount the shotgun 102 by physically pressing the contour gauge 710 onto the shoulder 126 such that the non-hardening amorphous material 720 is squeezed in order to form the shoulder facing contour 712 that matches the shoulder 126 of the clay pigeon shooter to a relatively close degree. As shown, when the shoulder facing contour 712 is formed in the non-hardening amorphous material 720, excess buildup 722 (e.g., overflow) of the non-hardening amorphous material 720 may occur around the edges of the contour gauge 710 in some cases. For example, the excess buildup 722 may occur due to the pressing action of the contour gauge 710 against the shoulder 126 of the clay pigeon shooter in order to form the shoulder facing contour 712.

FIG. 7E illustrates a side, cut-away view taken along the line 7A-7A of FIG. 7A of the contour gauge 710 with the excess buildup 722 of non-hardening amorphous material 720 removed. The excess buildup 722 may be removed in any suitable manner. In one embodiment, the excess buildup 722 may be removed using a knife, such as a single-ended razor blade, that is drawn along the sides of the contour gauge 710.

FIG. 7F illustrates a rear view of the blank recoil pad 718 having a contour marking line 714 configured on its side surface according to certain embodiments of the present disclosure. The contour marking line 714 may be created from the shoulder facing contour 712 generated by the contour gauge 710. The contour marking line 714 may be transferred in any suitable manner. In one embodiment, the contour marking line 714 may be created by aligning the contour gauge 710 directly on top of the blank recoil pad 718 and tracing the contour marking line 714 on the side surface of the blank recoil pad 718 using a suitable writing utensil, such as a pen, or pencil. In another embodiment, the contour marking line 714 may be created by tracing the shoulder facing contour 712 onto a suitable marking medium (e.g., paper, tape, etc.), and subsequently transferring the shoulder facing contour 712 onto the blank recoil pad 718 by wrapping the marking medium around a side of the blank recoil pad 718, and tracing the shoulder facing contour 712 onto the blank recoil pad 718.

Once the contour marking line 714 has been created, the blank recoil pad 718 may be cut along the contour marking line 714 to form the custom recoil pad 700 having a shoulder facing contour 712 that matches a shoulder contour of the clay pigeon shooter. In one embodiment, the shoulder facing contour 712 may be iteratively tailored to more closely match the contour of the user's shoulder. For example, a relatively thin sheet of pressure marking strip having layer of wax-like coloring agent disposed thereon may be temporarily configured on the shoulder facing contour 712 such that, when the shotgun 102 configured with the custom recoil pad 700 is mounted in the shooting position on the shoulder of the clay pigeon shooter, the wax-like coloring may be transferred to the shoulder facing contour 712 at locations where relatively high levels of pressure (e.g., contact) exist. The shotgun 102 may then be un-mounted and the shoulder facing contour 712 ground down at those locations such that the resulting shoulder facing contour 712 more closely matches the contour of the shoulder. The above described process may be repeated to iteratively refine the shoulder facing contour 712 to match that of the user's shoulder.

The cushion member 728 may have any un-cut thickness $T_1$ that provides sufficient cushioning at the narrowest portion $T_2$ of the shoulder facing contour 712, while encompassing a sufficient region of the shoulder's contour. Given the myriad of differing shoulder contours and sizes of many clay pigeon shooters, it has been determined that the cushion member 728 having an un-cut thickness $T_1$ of at least approximately 1.58" inches may provide relatively good cushioning at the narrowest portion $T_2$ of the shoulder facing contour, while providing a relatively good extent over the contour of the shoulder's contour of most clay pigeon shooters.

Although the recoil pad 700 as shown and described above is shaped (e.g., formed) by cutting (e.g., machining) the shoulder facing contour 712 in a blank recoil pad 718, it is contemplated that a custom recoil pad may be made by forming a negative mold around the contour gauge 710 to create a negative impression of the contour gauge 710 with the shoulder facing contour 712, and pouring a hardening material into the negative impression to form a cushion portion of the recoil pad. For example, the negative mold may be formed around a portion (e.g., the sidewall and shoulder facing contour 712) of the contour gauge 710 using a suitable material (e.g., gypsum plaster) that is poured around the contour gauge 712 and allowed to cure. After the negative mold has cured, an uncured mixture of hardening material (e.g., platinum cure silicone with a cured shore A hardness of 40) may be poured into the negative mold to form the cushion portion of the recoil pad. In one embodiment, a base member may be configured with undercut holes or recesses having any suitable shape and size that function as undercuts so that when the uncured hardening material is introduced (e.g., poured) into the negative mold 300, the base member may be placed against the negative mold such that a portion of the mold material may be pushed into the holes or recesses for securing the cushion member to the base member.

Although FIGS. 7A through 7H illustrate one or more particular embodiments of how to make the custom recoil pad 700, it should be appreciated that the custom recoil pad may be made using fewer, different, or additional steps than what is described herein. For example, a contour gauge (e.g., profile gauge) having multiple pins or slats that are set tightly against one another in a frame which keeps them in the same plane and parallel while allowing them to move independently, perpendicularly to the frame may be used in in place of the contour gauge 710 as described above if measuring the contour of the shoulder when the shotgun 102 is mounted is not needed or desired. As another example, the rods 704 and/or their associated holes 706 may be omitted from the custom recoil pad 700 if not needed or desired.

Figure 8A:
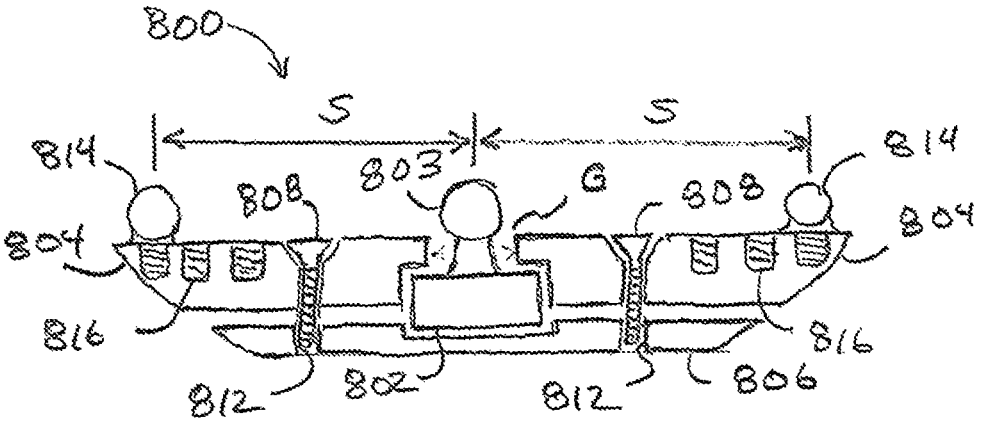
FIGS. 8A through 8D illustrate an example rear sight according to certain embodiments of the present disclosure.

FIG. 8A through 8D illustrate an example rear sight 800 according to certain embodiments of the present disclosure. In particular, FIG. 8A shows a cross-sectional view in which a portion of the rear sight 800 and rib 802 of a shotgun are cut away to reveal several components of the rear sight 800. A front sight 803 is configured above the rib 802 of the shotgun. The rear sight 800 includes two top members 804 that are positioned on either side of the rib 802 and a bottom member 806 positioned underneath the rib 802. Screws 808 are provided that project through each top member 804 and are secured to the bottom member 806 using threaded holes 812 configured in the bottom member 806. When the screws 808 are tightened, a portion of the rib 802 is sandwiched between the top members 804 and bottom member 806 using a compression-type friction fit. Each of the top members 804 includes a sighting rod 814, such as a fiber optic sight, that is mounted on the top of its respective top member 804. As shown, the each sighting rod 814 include a threaded stud that may be screwed into one of several threaded holes 816. In other embodiments, it is contemplated that each sighting rod 814 may be mounted on each top member 804 in any suitable manner.

Figure 8B:
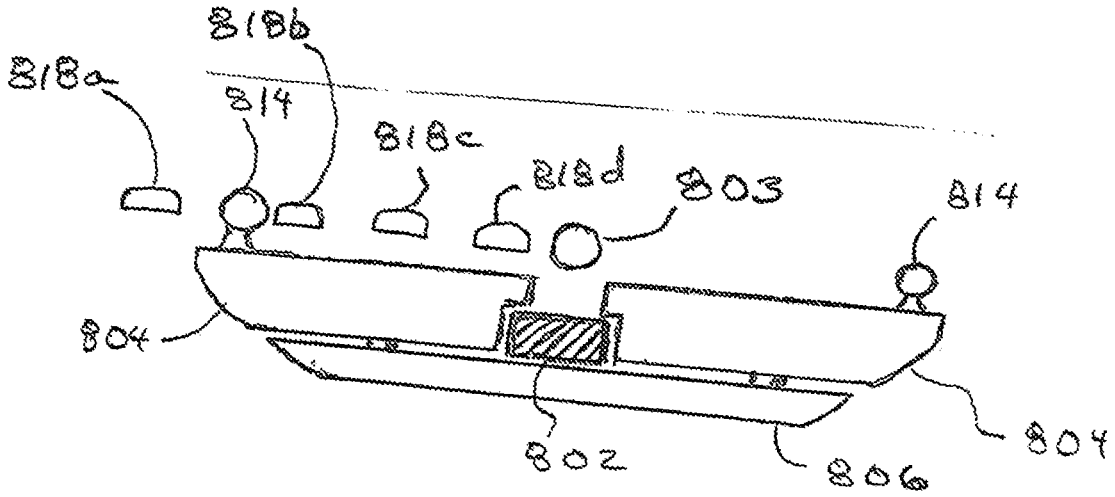
Figure 8C:
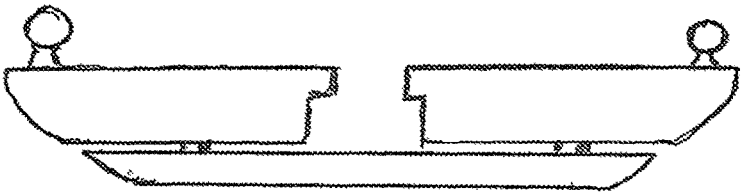
Figure 8D:
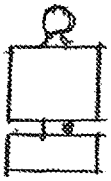

When the rear sight 800 is mounted on the rib 802, a gap G is formed over the top of the rib 802 so that a front sight 803 may be seen by the clay pigeon shooter. The multiple threaded holes 816 are provided a perpendicular spacing S relative to the rib 802. That is, each sighting rod 814 may be screwed into either of the multiple threaded holes 816 selecting a particular spacing S of each sighting rod 814 to the rib 802. Such a spacing S may be useful for, among other things, estimating a distance between the axis of the barrel and a location of a target. As shown in FIG. 8B for example, if the clay pigeon shooter desires to shoot at a target 818*a* (e.g., clay pigeon) with a 4 foot lead, the shotgun may be aimed such that the target when it appears slightly outside of one of the sighting members 814. If the clay pigeon shooter desires to shoot at another target 818*b* with a 3 foot lead, the shotgun may be aimed such that the target when it appears slightly inside of one of the sighting members 814. If the clay pigeon shooter desires to shoot at another target 818*c* with a 2 foot lead, the shotgun may be aimed such that the target when it appears in between one of the sighting members 814 and the front sight 803. If the clay pigeon shooter desires to shoot at yet another target 818*d* with a 1 foot lead, the shotgun may be aimed such that the target when it appears slightly to one side of the front sight 803. It should be understood that the relative positions of the target relative to the sighting members 814 and the front sight 803 are provided only as an example, and that other spacings of the sighting members 814 and mounting location of the rear sight 800 on the rib 802 may yield different relative positions of a target to the sighting members 814 and the front sight 803.

In one embodiment, an elevation of the sighting members 814 relative to the elevation of the rib 802 is adjustable by the clay pigeon shooter. For example, shims may be placed between the rib 802 and rear sight 800 when mounted. Other techniques for adjusting an elevation of a first element (e.g., the sighting members 814) relative to the elevation of a second element (e.g., the rib 802) are well known in the art. Adjustment of the sighting members 814 relative to the rib 802 may be useful for, among other things, aligning a height of the sighting members 814 to be relatively similar to that of the front sight 803.

The clay pigeon shooting system 100 as described above may be used to, among other things, enhance the enjoyment and entertainment of the clay shooting sports. Nevertheless, it is contemplated that the clay pigeon shooting system 100 can be used for guns in other shooting sports, such as hunting. Additionally, although a particular type of gun commonly referred to as a shotgun is described and shown herein, it is contemplated that embodiments of the present disclosure may be used with any suitable type of firearm for, among other things, reducing the detrimental effects of recoil on the shoulder of any user. The clay pigeon shooting system 100 shows and describes a recoil pad 120', 120", 500, 700 and a rear sight 124 that may function in a synergistic fashion for training in the clay shooting sports, increase competitiveness in the clay shooting sports, or other desired shooting endeavor. For example, the recoil pad 120', 120", 500, 700 to rear sight 124, 800 may provide a particular elevational shoulder to eye level setting that is consistent and precise for enhanced accuracy when shooting.

It is believed that the present disclosure and many of its attendant advantages will be understood by the foregoing description, and it will be apparent that various changes may be made in the form, construction, and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context of particular implementations. Functionality may be separated or combined in blocks differently in various embodiments of the disclosure or described with different terminology. These and other variations, modifications, additions, and improvements may fall within the scope of the disclosure as defined in the claims that follow.

What is claimed is:

1. A recoil pad comprising:

a base member configured to be mounted to a buttstock of a gun; and a cushion member comprising a first cushion portion and a second cushion portion, the first cushion member configured to deform in response to a recoil force of a gun, the first cushion portion affixed adjacent to the base member; and the second portion configured to deform in response to the recoil force of the gun, the second cushion portion configured to be releasably secured to the first cushion portion, wherein the first cushion portion is disposed between the second cushion portion and the base member when the second cushion portion is releasably secured to the first cushion portion, and wherein the first cushion portion comprises one or more undercut recesses configured to receive as portion of the second cushion portion.

2. The recoil pad of claim 1, wherein the second cushion portion comprises a cured polymer having an elastic consistency to at least partially deform in response to a recoil force of the gun.

3. The recoil pad of claim 2, wherein the cured polymer is formed from a two-part silicone polymer.

4. The recoil pad of claim 1, wherein the first cushion portion comprises an elastomeric polymer.

5. The recoil pad of claim 1, wherein the base member and the first cushion portion are machinable to modify a cross-sectional shape of the recoil pad to be similar to the cross-sectional shape of the buttstock.

6. The recoil pad of claim 1, further comprising one or more rods configured in a corresponding one or more holes in the cushion member, the rods being selectively removable for adjusting an effective softness of the recoil pad.

7. The recoil pad of claim 2, wherein the cured polymer of the second cushion portion comprises a material that is different than the material of the first cushion portion.

8. A recoil pad comprising:

a base member configured to be mounted to a buttstock of a gun;

a first cushion portion configured to deform in response to a recoil force of a gun, the first cushion portion affixed adjacent to the base member, and having a recess with a concave contour having a shape that at least partially matches a contour of a user; and a second cushion portion configured to deform in response to the recoil force of the gun, the second cushion portion configured to be releasably secured to the recess of the second cushion portion, and wherein the first cushion portion is disposed between the second cushion portion and the base member when the second cushion portion is releasably secured to the first cushion portion, the second cushion portion having a shoulder facing contour that matches the contour of the user.

9. A recoil pad comprising:

a base member configured to be mounted to a buttstock of a gun; and a cushion member comprising a first cushion portion and a second cushion portion, the first cushion member configured to deform in response to a recoil force of a gun, the first cushion portion affixed adjacent to the base member; and the second portion configured to deform in response to the recoil force of the gun, the second cushion portion configured to be releasably secured to the first cushion portion, wherein the first cushion portion is disposed between the second cushion portion and the base member when the second cushion portion is releasably secured to the first cushion portion, and wherein the first cushion portion comprises a recess having a contour that at least partially conforms to the contour of a shoulder of a user.

10. The recoil pad of claim 9, wherein the second cushion portion comprises a cured polymer having an elastic consistency to at least partially deform in response to a recoil force of the gun.

11. The recoil pad of claim 10, wherein the cured polymer is formed from a two-part silicone polymer.

12. The recoil pad of claim 9, wherein the first cushion portion comprises an elastomeric polymer.

13. The recoil pad of claim 9, wherein the first cushion portion comprises one or more undercut recesses configured to receive a portion of the second cushion portion.

14. The recoil pad of claim 9, wherein the base member and the first cushion portion are machinable to modify a cross-sectional shape of the recoil pad to be similar to the cross-sectional shape of the buttstock.

15. The recoil pad of claim 9, further comprising one or more rods configured in a corresponding one or more holes in the cushion member, the rods being selectively removable for adjusting an effective softness of the recoil pad.

16. The recoil pad of claim 10, wherein the cured polymer of the second cushion portion comprises a material that is different than the material of the first cushion portion.

17. The recoil pad of claim 9, wherein the first cushion portion comprises a recess having a contour that at least partially conforms to the contour of a shoulder of a user.

18. The recoil pad of claim 9, wherein the amorphous material comprises a non-hardening material configured to generate a shoulder contour indicium that can be transferred to a blank recoil pad.

* * * * *